US005183185A

United States Patent [19]

Hutcheson et al.

[11] Patent Number: 5,183,185

[45] Date of Patent: Feb. 2, 1993

[54] MECHANICALLY PRESSURIZED DISPENSER SYSTEM

[75] Inventors: Jerry D. Hutcheson, Littleton, Colo.; William S. Blake, Linwood, N.J.

[73] Assignee: Ecopac, L. P., Engelwood, Colo.

[21] Appl. No.: 656,195

[22] Filed: Feb. 14, 1991

[51] Int. Cl.[5] ..... B65D 37/00; B65D 88/54

[52] U.S. Cl. ..... 222/209; 222/252; 222/383; 222/386.5; 239/333; 417/540

[58] Field of Search ..... 222/207, 209, 212, 213, 222/252, 255, 340, 379, 380, 383, 386.5, 387, 398, 402.1, 402.2; 239/333; 417/540

[56] References Cited

U.S. PATENT DOCUMENTS

| | | | |
|---|---|---|---|
| 3,104,785 | 9/1963 | Beard, Jr. | 222/207 |
| 4,057,176 | 11/1977 | Horvath | 222/321 X |
| 4,174,052 | 11/1979 | Capra et al. | 222/207 |
| 4,222,500 | 9/1980 | Capra et al. | 222/207 |
| 4,241,853 | 12/1980 | Pauls et al. | 222/340 X |
| 4,485,943 | 12/1984 | Czech | 222/340 X |
| 4,564,130 | 1/1986 | Eulenburg | 222/207 |
| 4,607,762 | 8/1986 | Zulauf et al. | 222/207 X |
| 4,858,788 | 8/1989 | Meckenstock | 222/207 |
| 4,872,595 | 10/1989 | Hammett et al. | 222/209 |
| 4,892,232 | 1/1990 | Martin | 222/212 X |

*Primary Examiner*—Andres Kashnikow
*Assistant Examiner*—Kenneth DeRosa
*Attorney, Agent, or Firm*—Beaton & Swanson

[57] ABSTRACT

A mechanically pressurized system for dispensing a product, including a cap that houses a piston, an actuator attached to the cap so as to form a dispensing head assembly, and an expandable reservoir that is mechanically charged by the piston and dispensing head to hold a product for discharge through the dispensing head. The dispensing system is able to produce an aerosol spray without a chemical propellant.

35 Claims, 6 Drawing Sheets

MECHANICALLY PRESSURIZED DISPENSER SYSTEM

BACKGROUND OF THE INVENTION

The mechanically pressurized dispenser system of this invention relates to dispensers, and more particularly to aerosol dispensers that are pressurized by mechanical energy instead of by chemical energy.

Aerosol dispensers have been in use for more than forty years, and continue to gain in popularity because of their convenience of use. However, many of those dispensers rely upon chemical propellants, including chloro-fluorocarbons and hydrocarbon compounds, to pressurize the product. The use of chemical pressurizing agents creates special problems, including safety concerns in filling, shipping, handling, storing, using and disposing the pressurized and often flammable containers. Another set of concerns involves questions relating to the effect of certain pressurizing chemical agents upon the earth's ecosystem, including particular questions concerning their effect on the ozone layer, and questions concerning the effect of the release of volatile organic compounds into the atmosphere. Accordingly, there has been great interest in the development of aerosol dispensers that do not use chemical propellents, but which also retain the conveniences of use associated with the chemically charged dispensers.

Among the alternatives to chemically pressurized aerosol dispensers are various mechanically pressurized models using finger pumps and triggers. These typically require a continued vigorous pumping to produce a continuous spray, and, as a result, are inconvenient to use. Further, the duration of the spray is in most instances limited by the length of stroke of the pump or trigger; the pressure of the spray in most instances does not remain constant during a discharge cycle, but decreases rapidly near the end of the cycle with the spray becoming a wet stream or dribble; and the device must generally be operated in an upright position. In addition, many of the finger operated pumps are not capable of producing a fine mist or suitably atomized spray for use with such products as cosmetics and hair sprays. As a result, such devices only partially solve the problem of providing a convenient yet safe alternative to chemically pressurized aerosol dispensers.

Another alternative to chemically pressurized dispensers are various mechanically pressurized models that obtain prolonged spray time by storing a charge without the use of chemical propellents. Such "stored charge" dispensers include types that are mechanically pressurized at the point of assembly, as well as types that may be mechanically pressurized by an operator at the time of use.

Stored charge dispensers that are pressurized at the point of assembly often include a bladder that is pumped up with product. Examples include those described in U.S. Pat. Nos. 4,387,833 and 4,423,829.

Stored charge dispensers that are pressurized by an operator at the time of use typically include charging chambers that are charged by way of screw threads, cams, levers, ratchets, gears, or other constructions providing a mechanical advantage for pressurizing a product contained within a chamber. This type of dispenser will be referred to as a "charging chamber dispenser." Many ingenious charging chamber dispensers have been produced. Examples include those described in U.S. Pat. No. 4,872,595 of Hammett et al., assigned to the same assignee as the current patent; U.S. Pat. No. 4,222,500 of Capra et al., assigned to the same assignee as the current patent; U.S. Pat. No. 4,174,052 of Capra et al., assigned to the same assignee as the current patent; and U.S. Pat. No. 4,167,941 of Capra et al., assigned to the same assignee as the current patent.

While some of the prior stored charge dispensers avoid some or all of the difficulties of the finger pump or trigger dispensers, the stored charge dispensers tend to have drawbacks of their own. In the devices pressurized at the point of assembly, the charging chamber is often an elastic bladder that remains charged during the life of the product, degrading over time, and these devices typically cannot be refilled with product. Though some of the charging chamber devices, pressurized by an operator at the time of use, avoid those particular problems of other stored charge dispensers, the charging chamber dispensers tend to have drawbacks of their own. Chief among the drawbacks are that the charging chamber devices have been relatively difficult to manufacture due to their being composed of a large number of parts; and/or being composed of parts not readily suited to high quantity, high yield injection molding production techniques; and/or requiring that they be used with specially designed containers.

These drawbacks have tended to make the charging chamber dispensers expensive and not commercially feasible for mass market applications, and have tended to make other stored charge dispensers less than completely satisfactory substitutes for chemically pressurized dispensers. Accordingly, existing stored charge and charging chamber dispensers have only partially solved the problem of providing a convenient yet safe alternative to chemically pressurized aerosol dispensers.

The current invention is a charging chamber dispenser which possesses specific improvements so that it combines convenience of use with commercial feasibility. It is believed that this is, finally, a non-chemical aerosol that retains the desirable features commonly associated with chemical aerosols, and is, therefore, a non-chemical aerosol that can attain widespread vendor and customer acceptance.

SUMMARY OF THE INVENTION

The mechanically pressurized aerosol system of this invention in one of the preferred embodiments consists essentially of: (a) a cap which houses a piston, (b) an actuator movably attached to the cap, forming together with the cap a dispensing head assembly, and (c) an expandable elastic reservoir. The system is fitted over a standard container holding a liquid product, and includes a dip tube assembly to draw liquid into the dispensing head assembly from the container, and a standard discharge assembly, including an aerosol nozzle and valve, to release the contents out of the dispensing head assembly.

Complementary screw threads on the cap and actuator are pitched so that a short twist of the threaded cap raises the piston, opening a charging chamber within the dispensing head assembly. This creates a vacuum with the resulting suction pulling the product up through the dip tube to fill the charging chamber. Twisting the cap in the opposite direction lowers the piston in a downstroke which closes the charging chamber, forcing the product into the expandable elastic reservoir. The reservoir expands under pressure, holding the product for subsequent discharge. Pushing a button, which is part of the standard valve assembly in the cap, releases the product through the nozzle.

The general working of the system briefly summarized above is enhanced by several specific improvements, including: (a) use of a snap-in piston so that the piston and the cap may be separately molded, allowing different materials for each and easier mold forms, (b) use of a container which is a separate piece from the dispensing head assembly, permitting easy filling of the container, and taking advantage of ordinary bottles and standard bottling technology, (c) use of a "finger" attached to the bottom of the piston and which is inserted deeply into the elastic reservoir on each downstroke of the piston, having the double advantage of unexpectedly magnifying the pressure in the reservoir and also creating a positive shut off mechanism without the need of extra parts, (d) use of a reservoir, piston and actuator designed in such a way as to realize the additional advantages of establishing a one way valve mechanism for sealing the dip tube on the downstroke cycle, and also establishing a drain back mechanism for discharging undispensed product back into the container without the need of extra parts for either function, and (e) use of a piston sealing mechanism which produces a tight seal while maintaining a low coefficient of friction so as to make the mechanical twisting motions of the cap and actuator easy.

These and other specific improvements (and other embodiments) will be described in more detail later, and their significance will be explained. In summary, it is the cooperation of such elements as these in the system of this invention which results in a non-chemical aerosol that works from any position, even upside down, that does not require a finger pump to actuate, and that can be fitted to disposable or reusable containers. Further, the system of this invention produces a duration spray which does not become a wet stream or dribble near the end of the cycle, and a finely atomized high pressure spray which does not take inordinate mechanical force to charge. The system of this invention is simple and uses relatively few parts, all of which can be easily fabricated from existing materials and can be injection molded with existing mold techniques.

It is a specific objective of the system of this invention to solve substantially all of the problems that have, until now, prevented non-chemical aerosol dispensers from being widely accepted as the replacement for chemically pressurized aerosol dispensers.

BRIEF DESCRIPTION OF THE DRAWINGS

FIG. 1(*a*) is the same view as FIG. 1, but showing a detail of the charging chamber not present in FIG. 1.

FIG. 3(*b*) is a plan view of a third embodiment of the actuator assembly.

FIG. 13 (*b*) is the view of FIG. 13, showing details of the product flow channels in one of the other embodiments of the actuator assembly.

DETAILED DESCRIPTION OF THE PREFERRED EMBODIMENTS

Figure 1:
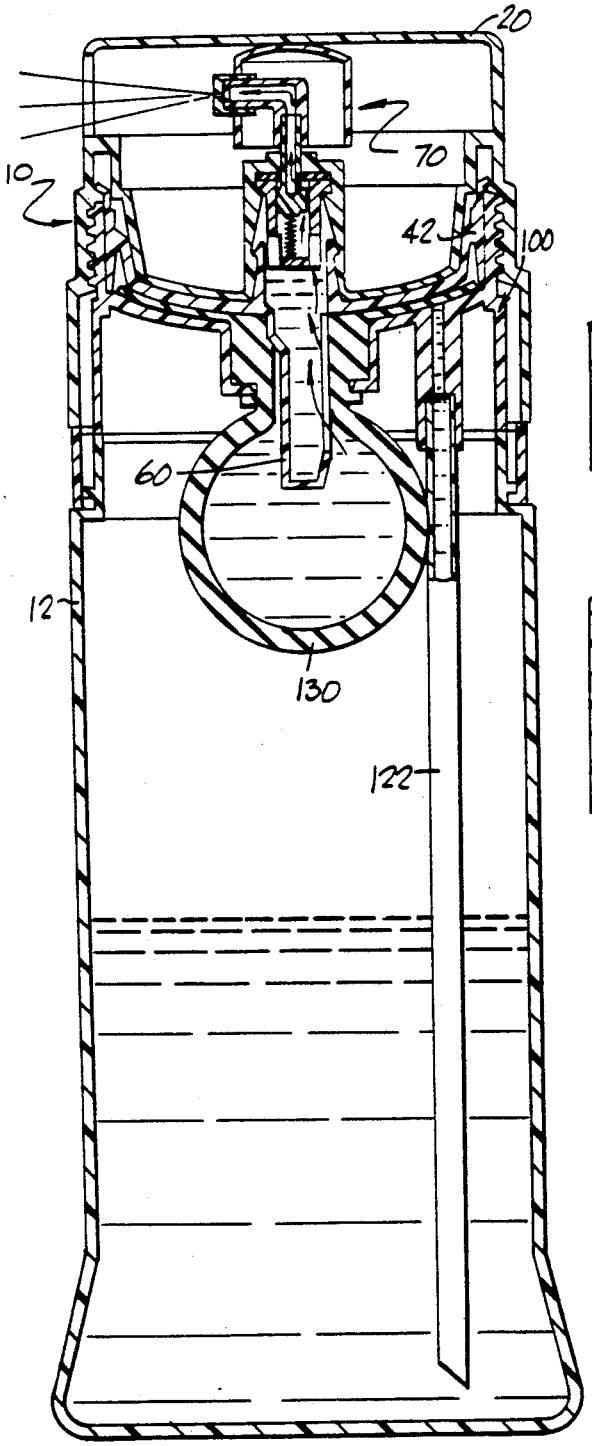
FIG. 1 is a diagrammatic plan view of the system of the invention.

In the following discussion, the mechanically pressurized aerosol dispenser system will be explained in stages, using drawings to aid in the description. Understanding that the major assemblies or parts of the system include: (a) a cap which houses a piston, (b) an actuator movably attached to the cap, forming together with the cap a dispensing head assembly, and (c) a reservoir, the initial stage of discussion will be an overview of the entire system. With reference to FIG. 1, the major assemblies and parts will be identified, and it will be seen that the system fits over a standard container and includes a dip tube assembly to draw product into the dispensing head assembly, and a standard discharge assembly, including an aerosol nozzle and valve, to release the contents out of the dispensing head assembly.

Figure 2:
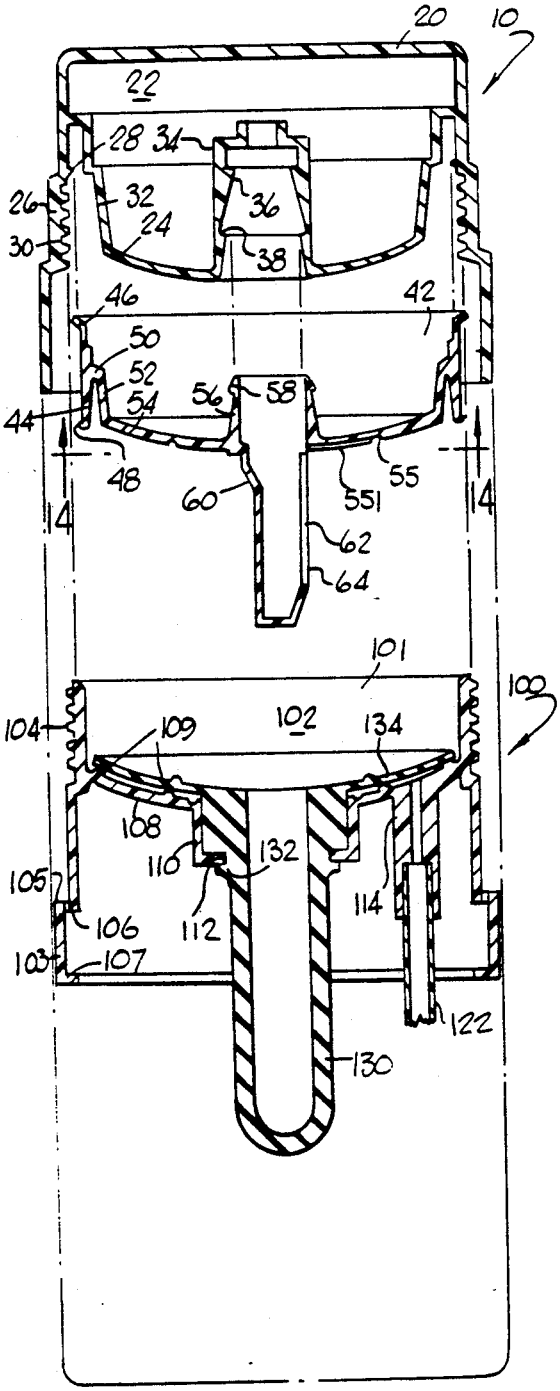
FIG. 2 is an exploded plan view of the cap assembly and actuator assembly (discharge assembly not shown), showing a first embodiment of the actuator assembly.
Figure 3A:
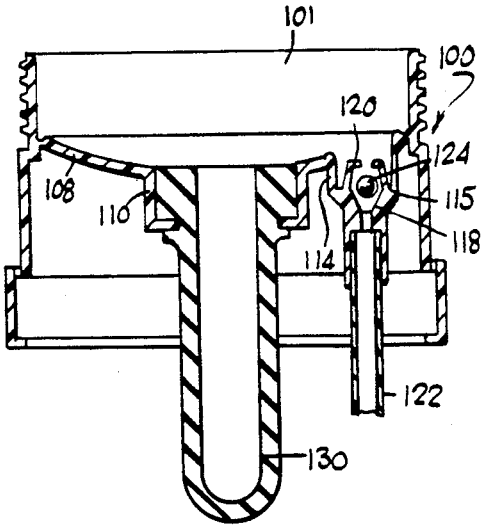
FIG. 3(*a*) is a plan view of a second embodiment of the actuator assembly.
Figure 3B:
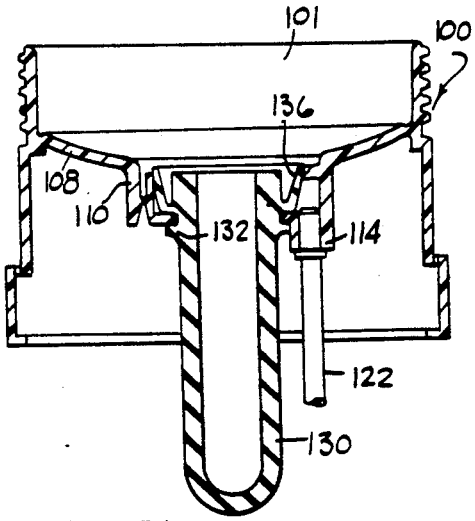

Understanding that the working of the system is enhanced by several specific improvements, the second stage of discussion will be a detailed discussion of the various assemblies and parts so that the several features, surfaces, and details of each can be seen. With reference to FIGS. 2 and 3, details of the cap, piston and actuator (including three embodiments of the actuator assembly) will be discussed. A standard aerosol valve discharge assembly will be discussed with reference to FIG. 4. During this stage of the discussion, the specific improvements will be identified. Their working will be explained subsequently.

Having seen the assemblies and parts, the next two stages of discussion will address how they are put together and used. The third stage of discussion, and FIGS. 5 through 10, will explain and illustrate the "initial cycle" of the system, in which the dispensing head assembly progresses through an unattached phase, a fully open phase, and a fully closed phase. The fourth stage of discussion, and FIGS. 11 and 12, will explain and illustrate schematically the "charging cycle" of the system in the fully open phase and the fully closed phase, showing product flow within the system.

Finally, the last stage of discussion will summarize and fill in the remaining details. The advantages of the system of this invention will become evident during the discussion.

OVERVIEW OF THE SYSTEM

With reference to FIG. 1, it can be seen that the system of this invention includes a cap 20 and an actuator assembly 100. The cap 20 houses a piston 42 and a discharge assembly 70. The actuator assembly 100 houses a reservoir 130 and a dip tube 122.

The piston 42, seated in the cap 20, includes a "finger" 60 protruding downwards at the center of the piston 42 and mating with the reservoir 130 of the actuator assembly 100. The discharge assembly 70, seated in the cap 20, is of standard design for dispensing an aerosol spray.

The reservoir 130, seated in the actuator assembly 100, is, in this embodiment, an elastomeric bladder, but may be any kind of reservoir which can expand under pressure, storing a force. Accordingly, the reservoir 130 will sometimes be referred to as an "expanding resistant reservoir" and should be understood to represent, not only the elastomeric bladder of this embodiment, but a means for resistably expanding a reservoir under pressure, including not only elastic reservoir containers but also spring loaded pistons and equivalent devices within rigid and semi-rigid reservoir containers, including containers having springs embedded within, or affixed to, flexible materials. The dip tube 122, seated in the actuator assembly 100, is a tube of standard dimension.

Figure 1A:
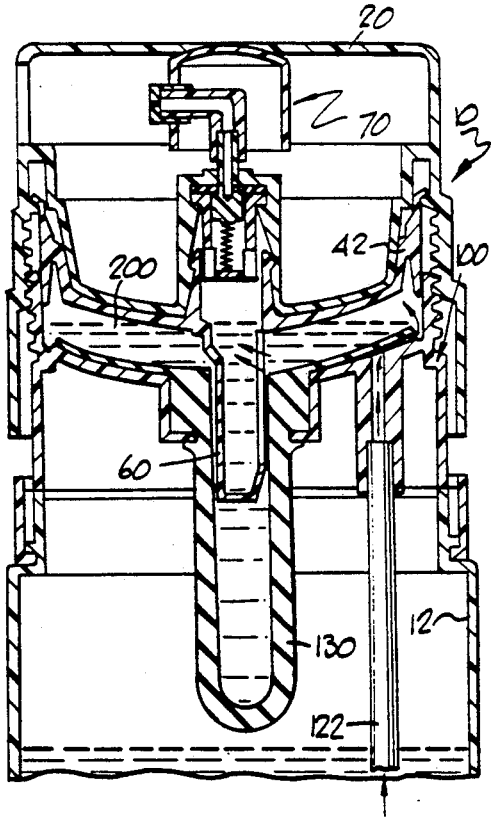

As will be explained in more detail later, the cap 20 is screwed onto the actuator assembly 100, forming together a dispensing head assembly 10. The dispensing head assembly 10 is fitted over a standard container 12 holding a liquid product. By a mechanical action of the dispensing head assembly 10, as will be explained in more detail later, the cap 20 and piston 42 can be raised and lowered in relation to the actuator assembly 100, forming a charging chamber 200 (the open charging chamber may be seen in FIG. 1*a*) within the dispensing head assembly 10.

When the piston 42 is raised, opening the charging chamber within the dispensing head assembly 10, a pressure differential is created, with the resulting suction pulling the product up from the container 12, through the dip tube 122, to fill the charging chamber. When the piston 42 is then lowered, the downstroke closes the charging chamber within the dispensing head assembly 10, forcing the product into the expanding resistant reservoir 130. The expanding resistant reservoir 130 expands under pressure, holding the product for subsequent discharge. The finger 60 of the piston 42, as it is inserted into the expanding resistant reservoir 130 on the downstroke, magnifies the pressure inside the reservoir 130 by decreasing the area otherwise present within the reservoir. Pushing a button which is part of the discharge assembly 70 seated in the cap 20 releases the product.

The foregoing is a very general overview of the system of this invention. It should be understood that the working of the system summarized above is enhanced by several specific improvements and functions that will be described later. Those improvements include: (a) use of a snap-in piston 42; (b) the creation of the charging chamber 200 within the dispensing head assembly 10, and independently of the container 12; (c) use of the finger 60 of the piston 42 for creating a fluid flow channel as well as for magnifying the pressure within the expanding resistant reservoir 130; (d) use of several elements of the system in cooperation for forming various functional mechanisms (such as a "one way valve" in the dip tube, a "drain back" from the pressurized expanding resistant reservoir 130 back to the container 12, and a "vent hole" allowing passage of air into the container 12) without the need for extra parts; and (e) use of a piston sealing mechanism between the piston 42 and the inner wall of the actuator assembly 100 so as to seal the charging chamber formed thereby while maintaining a low coefficient of friction.

These, and other specific improvements (and other embodiments) will be described in more detail later, and their significance will be explained. Having finished this overview of the system of this invention, the various assemblies and parts will be discussed next.

ASSEMBLIES AND PARTS OF THE SYSTEM

Figure 4:
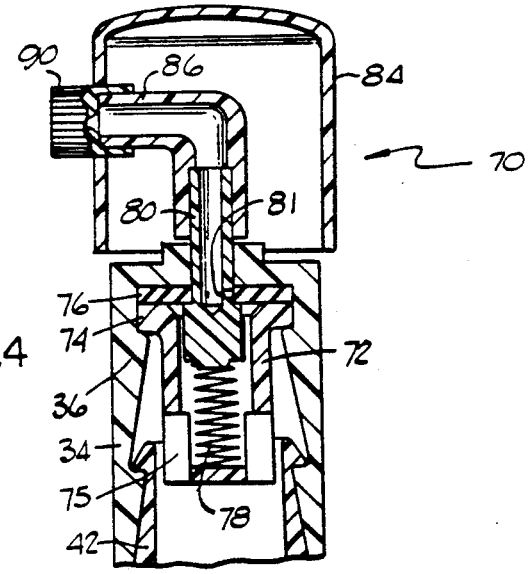
FIG. 4 is a plan view of the discharge assembly.

With reference to FIG. 2, it can be seen that the dispensing head assembly 10 includes (a) a cap 20 which houses a piston 42, and (b) an actuator assembly 100 which houses an expanding resistant reservoir 130 and a dip tube 122. Other embodiments of the actuator assembly 100 are shown in FIGS. 3(*a*) and 3(*b*), and the discharge assembly 70 which is housed in the cap 20 is shown in FIG. 4. This discussion will follow the assemblies and parts in the order of the drawings shown in the figures.

Referring to FIG. 2, the cap 20 contains a housing 22 which supports the piston 42 and the discharge assembly 70 (not shown in FIG. 2). The housing 22 of the cap 20 includes a floor 24, an outer wall 26, an inner wall 32, and an interior cylinder 34.

The outer wall 26 of the housing 22 contains, on its inner surface, a piston retaining bead 28 for retaining the piston 42, and screw threads 30 for attaching to the actuator assembly 100. The inner wall 32 of the housing 22 folds downward from the outer wall 26, opening a space between inner and outer walls of the housing 22 so as to afford room for the piston 42 and to support the piston. The floor 24 of the housing 22 is a spherical disc forming a face suitable for supporting the piston 42. The interior cylinder 34 of the housing 22 extends upward from the floor 24 at approximately the center of the floor. The interior cylinder 34 has, on its inside surface, a spring housing retaining lip 36 for retaining a spring housing (not shown in FIG. 2) and a piston retaining lip 38 for retaining the piston 42.

Still referring to FIG. 2, the piston 42 has an outer wall 44, an inner wall 52, a floor 54, an interior cylinder 56, and a finger 60.

The outer wall 44 of the piston 42 contains, on its outer surface, a snap rim 46 for snapping into the piston retaining bead 28 of the outer wall 26 of the cap 20, and a nib 48 for sealing the piston 42 against the wall 102 of the actuator 101. The nib 48 is a cylindrical molding that encircles the outer wall 44 of the piston 42. The inner wall 52 of the piston 42 folds downward from the outer wall 44 at a shoulder 50 located between the top and the bottom of the outer wall 44. The floor 54 of the piston 42 is a spherical disc having an annular groove 55 and a radial groove 551 on the bottom surface thereof. The interior cylinder 56 of the piston 42 extends upward from the floor 54 at approximately the center of the floor. The interior cylinder 56 of the piston has, on its outside surface, a snap rim 58 for snapping into the piston retaining lip 38 of the interior cylinder 34 of the cap 20. The finger 60 of the piston 42 extends downward from the floor 54 at approximately the center thereof. The finger 60 of the piston has a diameter slightly smaller than that of the interior cylinder 56 of the piston, and the finger 60 has a slot 62 running lengthwise up its surface. A ridge 64 surrounds the slot 62 on either side of the slot 62 and at the bottom of the slot 62. The communication of the hollow areas inside the finger 60 and inside the interior cylinder 56 of the piston 42 with the areas outside by way of a channel through the slot 62 of the finger 60 will be discussed later.

The piston 42 is snapped into the cap 20 so as to form, from separate pieces, a functionally single piece. As snapped in place, the outer wall 44 and inner wall 52 of the piston 42 fit within the space formed between the outer wall 26 and inner wall 32 of the cap 20. The inner wall 52 of the piston 42 is supported by the inner wall 32 of the cap 20. The floor 54 of the piston 42 is supported by the floor 24 of the cap 20. The interior cylinder 56 of the piston 42 is likewise supported by the interior cylinder 34 of the cap 20.

The use of a snap-in piston 42 has many benefits. An obvious benefit is the ease of molding. Other benefits flow from that one. The ability to achieve high quantity, high yield, low cost injection molded parts is a function of the thickness of the part, the complexity of the part, and the material used to make the part. Dividing the piston 42 and cap 20 into two parts makes them less costly to mold than would be the case if they had been one part. This is because the resulting two molds are each less complex than the corresponding single mold would have been. As a result, the two-piece cap and piston can contain a measure of detailing beyond what could be expected from a single piece equivalent. This level of detailing is important in forming the nib 48 and ridge 64 of the piston 42, and is essential in forming the finger 60 and slot 62 of the piston 42. The specific importance of those features will be discussed later, but they relate to establishing a seal that has a low coefficient of friction (so that the mechanical energy needed to pressurize the system is relatively low), to establishing a pressure magnifying mechanism, and to establishing a positive shut off mechanism (so that the product will discharge in a continuous mist, without any wet stream or dribble near the end of the cycle).

Other benefits follow from the ability to use different materials. Because of the support provided to the piston 42 by the inner wall 32, the floor 24, and interior cylinder 34 of the cap 20, it is possible to choose materials so as to make the cap 20 relatively strong and rigid; while making the piston 42 relatively flexible, light, and thin. This reinforces the advantage, mentioned above, of achieving a seal with a low coefficient of friction (the specific working of the seal will be explained later.)

Having completed this discussion of the cap 20 and piston 42, and still referring to FIG. 2, the actuator assembly 100 can be seen to include an actuator 101, together with an expanding resistant reservoir 130 and a dip tube 122, housed within the actuator 101. The actuator 101 is a cylinder, open at the top, having a wall 102, and a floor 108. The floor 108 of the actuator 101 supports a first interior cylinder 110 (referred to subsequently as the "reservoir housing 110") for housing the expanding resistant reservoir 130, and a second interior cylinder 114 (referred to subsequently as the "tube housing 114") for housing the dip tube 122.

The wall 102 of the actuator 101 contains a set of screw threads 104 extending to the top of the wall 102; an outward protruding rim 105 between the top of the wall 102 and the bottom of the wall; and a set of inward protruding lugs 107 at the bottom of the wall 102; in addition, there is a cylindrical surface near the bottom of the wall 102 that is referred to as the skirt 103. The screw threads 104 of the actuator 101 are complementary to the screw threads 30 of the cap 20 for screwing the cap onto the actuator 101. The rim 105 of the wall 102 extends horizontally outward from the wall 102 and has at least one vent hole 106 running vertically from top to bottom of the rim 105. The lugs 107 extend horizontally inward from the bottom of the wall 102 and are spaced equidistantly about the inner circumference of the cylinder formed by the wall 102 of the actuator 101. As will be explained later, the vent hole 106 is part of a mechanism to pass air into the container 12; the lugs 107 are part of a mechanism for detachably fastening the container 12 to the actuator 101; and the skirt 103 can afford a hand grip to the person operating the system.

The floor 108 of the actuator 101 is a spherical disc having (in this first embodiment) annular ridges 109 on its top surface. The reservoir housing 110 of the actuator 101 is a cylinder that extends downwards from the floor 108 at about the center of the floor. The tube housing 114 of the actuator is a cylinder that extends downwards from the floor 108 at a location on the floor 108 between the reservoir housing 110 and the wall 102.

The reservoir housing 110 of the actuator 101 has a retaining lip 112 on its inner surface for retaining the expanding resistant reservoir 130. The expanding resistant reservoir 130 of this first embodiment is an elastomeric bladder having a snap rim 132 for snapping into the retaining lip 112 of the reservoir housing 110 and having a horizontal flange 134 radiating outward from the top of the reservoir 130. The horizontal flange 134 forms a circular member that covers the floor 108 of the actuator 101 and also covers the mouth of the tube housing 114. The annular ridges 109 of the floor 108 of the actuator 101 help to form a seal against the horizontal flange 134 of the reservoir 130. The working of the horizontal flange 134 as it creates a one way valve over the dip tube 122 will be explained later. Other embodiments of the expanding resistant reservoir will be discussed in connection with FIGS. 3(*a*) and 3(*b*).

The dip tube 122 is press-fit into the tube housing 114 of the actuator 101. The dip tube 122 is a standard tube of a dimension suitable for drawing product up from the container 12.

Having already seen that the piston 42 snaps into the cap 20, it can now be understood that the cap 20 (with the piston attached to it) can screw onto the actuator 101 of the actuator assembly 100. The screw threads 30 of the cap 20 are complementary to the screw threads 104 of the actuator 101. Once the cap 20 is attached to the actuator 101, as will be described later in connection with FIGS. 5 through 8, the cap 20 and actuator assembly 100 together form a dispensing head assembly 10 that is an essentially self contained unit which does not come apart again by unscrewing. As a result, the dispensing head assembly 10 is a functionally unitary assembly. Also, and in particular, it should be understood that the dispensing head assembly 10 forms and contains its own charging chamber 200 (see FIG. 1a) and reservoir 130 without the necessity of cooperating with specially formed surfaces or structures of the container 12. Accordingly, the container 12 can be any standard container, and need not be specially made to withstand gas pressure-in particular, it need not be cylindrical/round in shape, and it need not be of heavy or thick material. Moreover, the container 12 can be disposable or reusable and can be filled and refilled readily with ordinary techniques.

The discussion related to FIG. 2 has explained and illustrated a first embodiment of the expanding resistant reservoir 130 and actuator assembly 100. FIGS. 3(*a*) and 3(*b*) illustrate a second and third embodiment. The different embodiments represent different structures for effecting a one way valve mechanism. The one way valve mechanism is used in conjunction with the dip tube 122 so as to permit the product to flow into the charging chamber of the dispensing head assembly 10 when the chamber is opened, but to prevent the product from flowing back down the dip tube when the chamber is closed.

As an aid in following the discussion, it should be noted that the parts of the actuator assemblies of FIGS. 3(*a*) and 3(*b*) are essentially the same as those of FIG. 2, except where differences are pointed out. Those differences have to do principally with (a) the structure and location of the tube housing 114 that supports the dip tube 122 from the floor 108 of the actuator 101, and (b) the shape of the expanding resistant reservoir 130 seated in the reservoir housing 110 of the actuator 101.

The tube housing 114 of FIG. 3(*a*) has an enlarged opening at its mouth (not separately numbered) which is wide enough to seat a check ball 124 within a cavity formed beneath the plane of the floor 108 of the actuator 101. The cavity is a tapering cylindrical chamber formed from surfaces within the tube housing 114. The tube housing 114 extends cylindrically downward to a shoulder 115 on its inner surface. From the shoulder 115, a tapering wall 118 extends downward and at an angle from the cylinder of the tube housing 114. It can be seen that the tapering wall 118 describes a cone in which the conic sections have a decreasing diameter from top to bottom. At the shoulder 115, and above the cone formed by the tapering wall 118, are a number of retaining rods 120. Each retaining rod 120 is attached at its bottom to the shoulder 115 and is angled upwards and inwards so that the retaining rods 120 describe a cone in which the conic sections have a decreasing diameter from bottom to top. It can be seen that the retaining rods 120 form a loose cap over the shoulder 115 of the tube housing 114. The check ball 124 sits within the concavity formed by the tapering wall 118 of the tube housing 114 and is loosely contained in place by the cap formed by the retaining rods 120. The expanding resistant reservoir 130 of FIG. 3(*a*) differs from that of FIG. 2 in only one respect. The reservoir 130 of FIG. 3(*a*) lacks the horizontal flange 134 of the reservoir 130 of FIG. 2, but is otherwise the same.

The tube housing 114 of FIG. 3(*b*) differs from that of FIG. 2 primarily in its location and formation. The tube housing 114 of FIG. 3(*b*) is located near to, and is formed as a part of, the reservoir housing 110 of the actuator 101. The expanding resistant reservoir 130 of FIG. 3(*b*) differs from that of FIG. 2 in two respects. The reservoir 130 of FIG. 3(*b*) lacks the horizontal flange 134 of the reservoir 130 of FIG. 2. In place of the horizontal flange 134, the reservoir 130 of FIG. 3(*b*) has a vertical flange 136 which forms a soft outer wall about the reservoir 130 folding outward from a point slightly above the snap rim 132 of the reservoir 130.

The operation of the three one way valve mechanisms can now be explained. In the first embodiment, and with reference to FIG. 2, the horizontal flange 134 of the reservoir 130 is lifted slightly above the floor 108 of the actuator 101 when pressure differentials cause the product to enter the charging chamber from the container 12 through the dip tube 122. The lifting of the horizontal flange 134 during this phase of the cycle permits product to enter the charging chamber as the chamber is opened. When the charging chamber is closed, however, the forces pushing down on the horizontal flange 134 work to press the flap tightly against the tube housing 114. The seal formed by the flange 134 against the tube housing 114 during this phase of the cycle prevents product from returning to the container 12 through the dip tube 122.

In the second embodiment, and with reference to FIG. 3(*a*), the check ball 124 is lifted slightly above the tapering wall 118 of the tube housing 114 when pressure differentials cause the product to enter the charging chamber from the container 12 through the dip tube 122. The lifting of the check ball 124 during this phase of the cycle permits product to enter the charging chamber as the chamber is opened. When the charging chamber is closed, however, the forces pushing down on the check ball 124 work to press the ball tightly against the cone formed by the tapering wall 118 of the tube housing 114. The seal formed by the ball 124 against the tapering wall 118 of the tube housing 114 during this phase of the cycle prevents product from returning to the container 12 through the dip tube 122. The retaining rods 120 permit a loose range of motion to the check ball 124, but prevent the check ball from moving out of position.

In the third embodiment, and with reference to FIG. 3(*b*), the vertical flange 136 of the expanding resistant reservoir 130 is pushed slightly inwards towards the center of the reservoir 130 when pressure differentials cause the product to enter the charging chamber from the container 12 through the dip tube 122. The inward movement of the vertical flange 136 during this phase of the cycle creates an opening about the inside of the reservoir housing 110 of the actuator 101 and permits product to enter the charging chamber as the chamber is opened. When the charging chamber is closed, however, the forces pushing against the vertical flange 136 work to press the flange tightly against the inside of the reservoir housing 110. The seal formed by the vertical flange 136 against the inside of the reservoir housing 110 of the actuator 101 during this phase of the cycle prevents product from returning to the container 12 through the dip tube 122.

Before leaving the subject of the embodiments of the actuator assembly 100, it should be noted again that the expanding resistant reservoir 130 of the actuator assembly 100 has been shown and described above as an elastomeric bladder, but may be any kind of reservoir which can expand under pressure, storing a force. Accordingly, the reservoir 130 should be understood to represent, not only the elastomeric bladder of this embodiment, but more generally, a means for resistably expanding a reservoir under pressure, including not only elastic reservoir containers but also structures consisting of spring loaded pistons and equivalent devices mounted within rigid and semi-rigid reservoir containers, including containers having springs embedded within, or affixed to, flexible materials. Such structures are well known and are not further described here. For the remainder of the description of the system of this invention, the actuator assembly 100 as embodied in FIG. 2 will be shown, but it should be understood that the other embodiments may be substituted for the illustrated actuator assembly 100.

Having completed the description of the cap 20, piston 42, and the several embodiments of the actuator assembly 100, it remains only to discuss the discharge assembly 70 which is housed in the cap 20.

With reference to FIG. 4, the discharge assembly 70 includes a spring housing 72 and a spray head 84. The spring housing 72 is a cylindrical container closed at one end and open at the other end. The spring housing 72 has a snap rim 74 at the open end for snapping into the spring housing retaining lip 36 of the interior cylinder 34 of the cap 20 (the cap 20 is not shown in FIG. 4). The spring housing 72 has two slots 75, each running lengthwise from the bottom of the housing to a mid point of the housing for presenting an opening for fluid flow into the hollow inside of the spring housing. The spring housing 72 houses within it a spring 78, and a valve 80.

The valve 80 housed within the spring housing 72 is a hollow cylinder, open at the top and closed at the bottom, and having a shoulder (not separately numbered); the valve 80 is slightly larger in diameter below the shoulder than above the shoulder. The valve 80 has an opening 81 located slightly above the shoulder of the valve; the opening 81 communicates from the hollow interior of the valve 80 to the outside. The spring 78 housed within the spring housing 72 is seated, at one end thereof, against the bottom face of the spring housing 72, and, at the other end thereof, against the bottom of the valve 80.

There is a gasket 76 seated above the spring housing 72. When positioned over the lip 36 of the interior cylinder 34 of the cap 20 (the cap 20 is not shown in FIG. 4) with the spring housing 72 beneath it, the gasket 76 tightly encircles the valve 80 and seals the cap 20.

The spray head 84 is a cylindrical container closed at the top, open at the bottom, and having a circular hole on its side. The spray head 84 contains a nozzle 90 and a spray tube 86. The nozzle 90 fits into the circular hole at the side of the spray head 84. The spray tube 86 is press-fitted, at one end of the spray tube 86, into the nozzle 90, and, at the other end of the spray tube 86, over the valve 80.

It can be understood that a fluid flow path exists from the inside of the piston 42 into the inside of the spring housing 72 by way of the slots 75 of the spring housing. Likewise, a fluid flow path exists from the inside of the valve 80 directly into the inside of the spray tube 86 and, from the spray tube 86, directly to the nozzle 90. The fluid flow path is controlled at the opening 81 of the valve 80. When the opening 81 is positioned against the inside lip of the gasket 76, no fluid can pass from the inside of the spring housing 72 to the inside of the valve 80 and the valve is "closed." The action of the spring 78 against the bottom of the valve 80 works to push the shoulder of the valve 80 against the gasket 76. In this position, the opening 81 of the valve 80 is positioned against the inside lip of the gasket 76 and the valve is closed.

The valve may be opened by manual pressure applied on the top of the spray head 84, pushing it downwards. As the spray head 84 is pushed downwards, the spray tube 86 pushes the valve 80 downwards. As the valve 80 is pushed downwards, the opening 81 of the valve is pushed beneath the lip of the gasket 76 and adjacent to the inside of the spring housing 72. In this position, the opening 81 of the valve 80 is unobstructed and the valve is open for fluid flow from the inside of the spring housing 72 to the inside of the valve 80.

The foregoing discharge assembly 70 is well known and is described here in only so much detail as necessary to understand the structure which, in this embodiment, constitutes an outlet means for letting product out of the dispensing head assembly 10 of the system of this invention.

THE INITIAL CYCLE OF THE SYSTEM

Having completed the description of the assemblies and parts of the system, the "initial cycle" of the operation of the system can be seen with reference to FIGS. 5 through 10. The initial cycle refers generally to the series of operations by which the cap 20 and actuator assembly 100 are attached to one another to form a dispensing head assembly 10. In this description, the initial cycle is distinguished from the "charging cycle" which will be discussed later and which refers to the actual operation of the dispensing head assembly 10.

Figure 5:
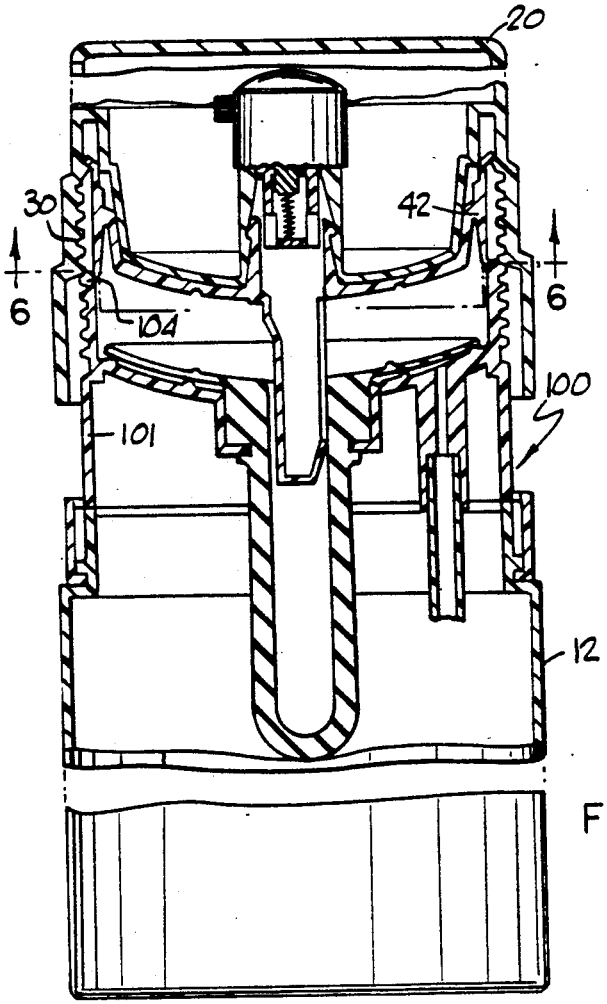
FIG. 5 is a plan view of the dispensing head assembly in the unattached phase of the initial cycle.

Referring to FIG. 5, the cap 20 has the piston 42 snapped into place as previously described. Likewise, the actuator assembly 100 can be understood to be attached to a container 12. What will be described throughout the initial cycle of the system is the connection of the cap 20 to the actuator assembly 100.

Figure 6:
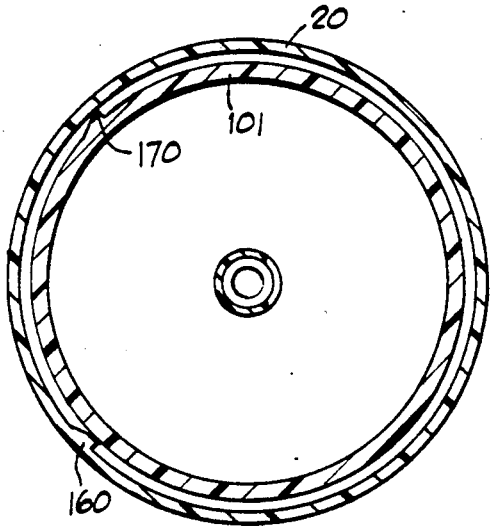
FIG. 6 is a cross sectional cut away view of FIG. 5, showing certain details of the cap and actuator.

In the first phase (referred to as the "initial position") of this cycle, the cap 20 is placed on top of the actuator assembly 100. As can be seen in FIG. 5, the screw threads 30 of the cap 20 are not yet engaged with the complementary screw threads 104 of the actuator 101. The cross sectional cut away view of FIG. 6 shows a notched tooth 160 on the inside surface of the cap 20 and a notched tooth 170 on the outside surface of the actuator 101. In this phase, the teeth 160 and 170 are not yet engaged.

Figure 7:
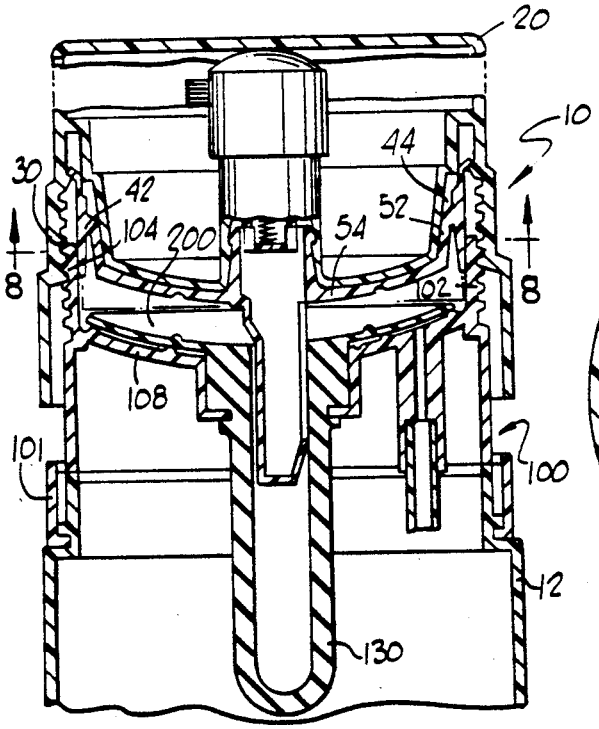
FIG. 7 is a plan view of the dispensing head assembly in the fully open phase of the initial cycle.
Figure 8:
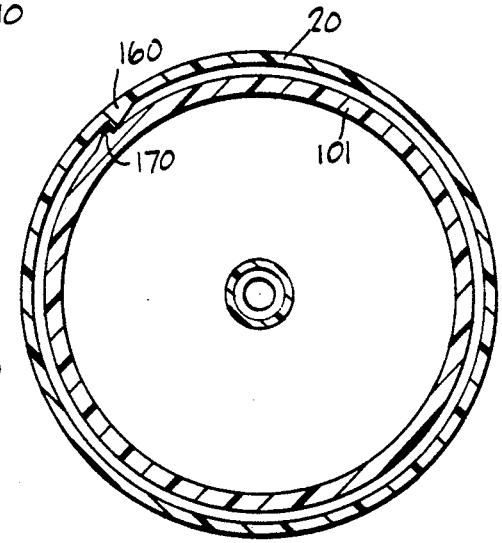
FIG. 8 is a cross sectional cut away view of FIG. 7, showing certain details of the cap and actuator.

In the second phase (referred to as the "fully opened position") of this cycle, the cap 20 is screwed onto the actuator 101 just enough to engage the screw threads. As can be seen in FIG. 7, the screw threads 30 of the cap 20 are just engaged with the complementary screw threads 104 of the actuator 101. The cross sectional cut away view of FIG. 8 shows that the notched tooth 160 of the cap 20 is engaged with the notched tooth 170 of the actuator 101. The teeth are engaged so that, assuming the actuator 101 to be held steady and the cap 20 to be rotated about it, the cap 20 can be rotated clockwise only. The cap 20 is prevented from rotating counterclockwise by the engagement of the teeth. Where a clockwise turn will further engage the screw threads of the cap 20 and actuator 101, and a counterclockwise turn would disengage the screw threads, it can be understood that the teeth prevent the cap 20 from being released from the actuator 101.

At this point, the cap 20 and actuator assembly 100 are movably fastened together to form the dispensing head assembly 10. In the fully opened position, and again referring to FIG. 7, the dispensing head assembly forms a charging chamber 200. The charging chamber 200 is a cylinder having its wall formed by the wall 102 of the actuator 101, and its floor determined by the floor 108 of the actuator 101 and by the inside of the reservoir 130. Further, the actuator 101 accepts the piston 42 of the cap 20 so that the outer wall 44, inner wall 52, and floor 54 of the piston 42 also define the boundaries the charging chamber 200.

Figure 9:
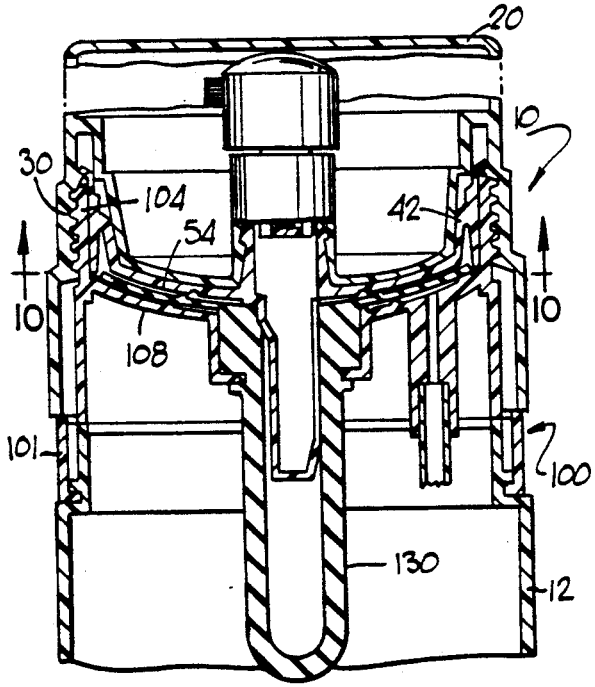
FIG. 9 is a plan view of the dispensing head assembly in the fully closed phase of the initial cycle.
Figure 10:
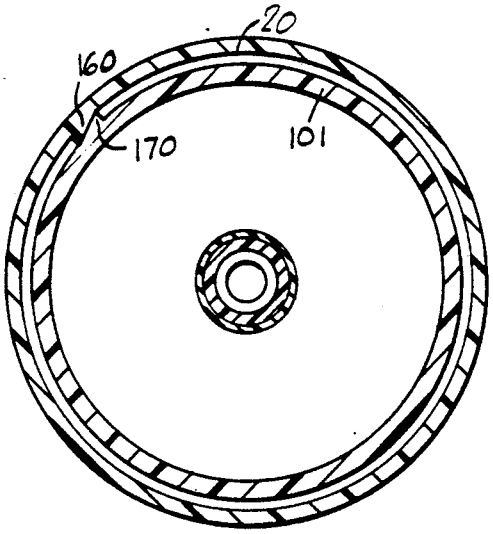
FIG. 10 is a cross sectional cut away view of FIG. 9, showing certain details of the cap and actuator.

In the third and final phase (referred to as the "fully closed position") of the initial cycle, the cap 20 is screwed all the way onto the actuator 101. As can be seen in FIG. 9, the screw threads 30 of the cap 20 are completely engaged with the complementary screw threads 104 of the actuator 101. The pitch of the screw threads is such that not quite a single turn of the cap 20 clockwise about the actuator 101 suffices to take the dispensing head assembly 10 from the fully opened position shown in FIG. 7 to the fully closed position shown in FIG. 9. Accordingly, and as shown in the cross sectional cut away view of FIG. 10, the notched tooth 160 of the cap 20 is not engaged against the notched tooth 170 of the actuator 101. As a result, the cap 20 is still free to rotate counterclockwise back around the actuator 101. Reference to FIGS. 8 and 10 will help to illustrate that the dispensing head assembly 10 is free to open and close, as a clockwise turn of the cap 20 starting from the position of FIG. 8 will lead to the orientation of FIG. 10 (moving the assembly from fully opened to fully closed); and a counterclockwise turn of the cap 20 starting from the position of FIG. 10 will lead to the position of FIG. 8 (returning the assembly from fully closed to fully opened). While the notched teeth prevent overturning in one direction, the pitch of the screw threads (and the meeting of the piston 42 and the actuator 101) prevents overturning in the other direction.

In the fully closed position, the charging chamber 200, discussed with reference to FIG. 7, is all but eliminated. A comparison of FIG. 7 with FIG. 9 helps to demonstrate that, in the fully closed position, the floor 54 of the piston 42 is essentially in contact with the floor 108 of the actuator 101. The space between piston 42 and actuator 101, which had defined the boundaries of the charging chamber 200 is substantially eliminated. Essentially all that remains of the charging chamber 200 in the fully closed position is so much of it as is inside the reservoir 130.

It should be understood that the initial cycle takes the assembly to a point prior to use. That is, the assembly is taken from an initial position, in which the cap 20 is first placed on top of the actuator assembly 100 (ref. FIG. 5); to a fully opened position, in which the cap 20 is attached to the actuator assembly 100 forming a dispensing head assembly that cannot be separated by unscrewing, and creating a charging chamber 200 (ref. FIG. 7); to a fully closed position in which the charging chamber 200 is essentially eliminated by the downstroke of the piston 42 (ref. FIG. 9). This initial cycle can represent a way of putting the assembly together, with the final phase of the cycle resulting in the assembly's attaining a fully closed position in which the assembly may be securely shipped and stored, even with the assembly attached to a container 12 fully loaded with product. This is possible because no product was drawn into the charging chamber 200 at any phase of this initial cycle and, with the assembly in the final, fully closed position, there is no charging chamber 200 to accept any product.

THE CHARGING CYCLE OF THE SYSTEM

Figure 11:
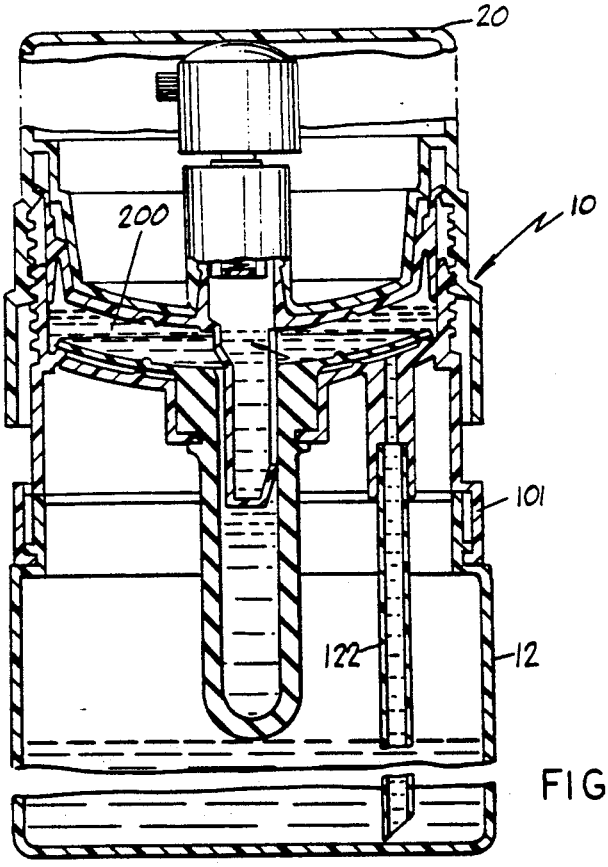
FIG. 11 is a schematic plan view of the dispensing head assembly in the fully open phase of the charging cycle, showing product flow into the charging chamber.
Figure 12:
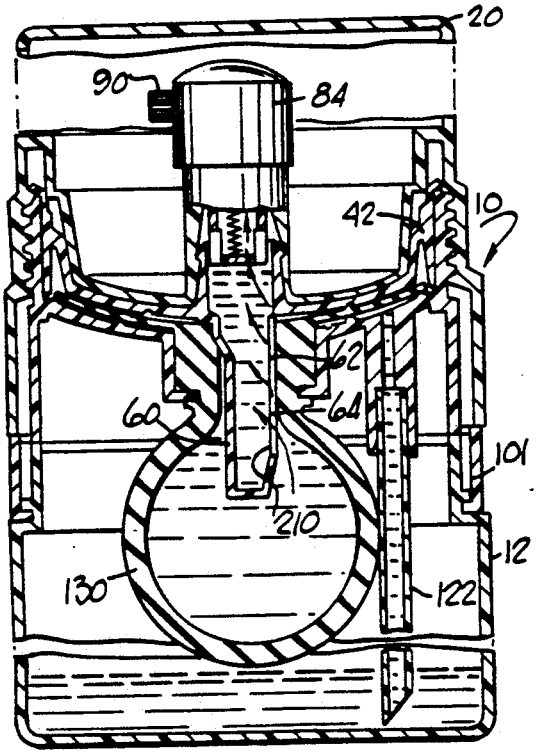
FIG. 12 is a schematic plan view of the dispensing head assembly in the fully closed phase of the charging cycle, showing product flow out of the reservoir and through the discharge assembly.

Having completed a description of the initial cycle of the system, its operation can be better understood in connection with its charging cycle, and with reference to FIGS. 11 and 12. Let us begin this portion of the discussion with the assembly at the point where the initial cycle is completed, and with the assembly in the fully closed position (ref. FIG. 9) and attached to a container 12 containing a liquid product. From this position, the operator of the system then twists the cap 20 counterclockwise about the actuator 101, opening the dispensing head assembly 10.

The opening of the dispensing head assembly 10 above a container 12 will create a pressure differential. With reference to FIG. 11, it can be seen that the opening of the dispensing head assembly 10 opens the charging chamber 200. The suction created by the pressure differential between the charging chamber 200 and the container 12 draws the liquid product out of the container 12, through the dip tube 122 and into the charging chamber 200. From this position, the operator of the system twists the cap 20 clockwise about the actuator 101 until the dispensing head assembly is in the fully closed position.

The closing of the dispensing head assembly compresses the charging chamber 200, pressurizing the product. With reference to FIG. 12, it can be seen that the closing of the dispensing head assembly 10 lowers the piston 42 and essentially eliminates the charging chamber 200. The product which had been in the charging chamber 200 is forced into the expanding resistant reservoir 130. As has already been mentioned (in connection with FIGS. 2, 3(*a*) and 3(*b*) above), a one way valve means seals dip tube 122 and prevents product from returning back to the container 12 during the downstroke of the piston; likewise, the reservoir 130, shown as an elastomeric bladder in this embodiment, is a means for expanding under pressure.

Pressure is created within the reservoir 130 by the compression of the charging chamber 200 during the downstroke of the piston 42. The wall of the reservoir 130 expands under pressure, drawing away from the finger 60 of the piston 42. As has already been mentioned (in connection with FIG. 2 above), the finger 60 has a slot 62, and a ridge 64 which seals the slot, running lengthwise up the side of the finger. It can now be seen that the finger 60 has an opening into the inside of the piston 42 by way of the slot 62. As the wall of the reservoir 130 draws away from the finger 60, the slot 62 of the finger 42 is opened at a channel 210. The energy of the expanding resistant reservoir 130 as it tries to resist expansion and as it seeks to contract, forces product into the channel 210, through the slot 62, and into the inside of the piston 42. As has already been mentioned (in connection with FIG. 4 above), the inside of the piston 42 is part of a fluid flow path leading to a valve 80 which is part of an outlet means for dispensing the product when the operator depresses the button formed by the top of the spray head 84. When the operator presses the button, the product is dispensed through the nozzle 90.

As long as the operator of the system presses the button, there will be a constant duration spray as the expanding resistant reservoir 130 contracts. During the contraction of the reservoir 130, the contracting wall of the reservoir begins to approach the finger 60 of the piston 42. At a certain point, the contracting wall of the reservoir will so contract over the finger 60 as to cover the channel 210. When the channel 210 is covered, the slot 62 of the finger 60 is closed to further fluid flow from the reservoir 130. At that point, and while the product is still being dispensed under pressure, there is a positive shut off of any additional product. The effect is to eliminate the wet stream or dribble that might otherwise exist were the product allowed simply to discharge until the pressure was exhausted completely. Instead, the product is discharged under relatively constant pressure, and shuts off abruptly before reaching the stage of a dribble.

SPECIFIC FEATURES OF THE SYSTEM

Having now completed a discussion of the assemblies and parts of the system, the initial cycle of the system, and the charging cycle of the system, most of the features of the system and most aspects of its assembly and use have been explained or have become apparent. This last portion of the description will summarize some of those features already discussed and will complete the discussion of certain remaining features not yet discussed.

It has been seen that the general working of the system of this invention is enhanced by several specific improvements, including the following:

(a) The system uses a snap-in piston so that the piston and the cap may be separately molded, allowing different materials for each and easier mold forms (ref. the discussion accompanying FIG. 2).

(b) The system uses a container which is a separate piece from the dispensing head assembly, permitting easy filling and taking advantage of ordinary bottles and standard bottling technology. Because the pressure is contained within the charging chamber 200 and reservoir 130, the container 12 need not itself withstand pressure, and the container can be made in various shapes (not restricted to cylinder/round) and materials (not restricted to relatively heavy duty plastics, glasses, and metals).

Figure 16:
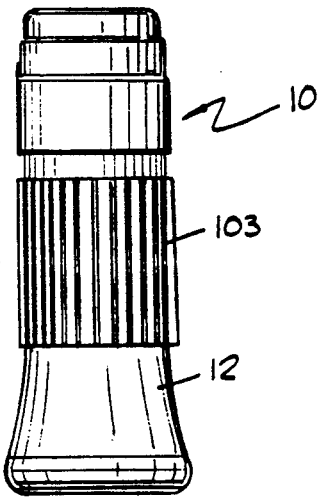
FIG. 16 is a schematic view of the system of the invention, showing an embodiment of the actuator skirt providing a convenient hand grip.

Because the charging chamber is completely formed within the dispensing head assembly, there is no need for any particular container specially adapted to the dispensing head. Instead, the lugs 107 of the actuator 101 (ref., e.g., FIG. 2) can be disposed so as to attach to a standard bottle in any number of ways. One way is to dispose the flanges in a "bayonet housing" of the type commonly used in child-proof caps. Another way is to use a standard screw thread bottle, using an embodiment of the skirt 103 of the actuator 101 to provide a hand grip to the operator so that the operator will not turn the bottle inadvertantly (this embodiment will be discussed later, in connection with FIG. 16). This attachment to a bottle secures the bottle to the dispensing head assembly in such a way that the bottle will not accidently detach from the dispensing head assembly, but can be detached when the operator desires. Moreover, because the only necessary connection between the dispensing head assembly and any container is by way of the dip tube, it is not necessary to limit the use of the dispensing head assembly even to standard bottles. Any sort of container may be in communication with the end of the dip tube, and such containers need not even be physically attached to the dispensing head assembly 20. Accordingly, it should be apparent that the structure recited in this specification for the container indicates a means for containing a product to be dispensed from the dispensing head assembly of this system that could be embodied in any number of other ways.

(c) The system uses a finger attached to the bottom of the piston and which is inserted deeply into the reservoir on each downstroke of the piston. In addition to magnifying the pressure in the reservoir, the finger creates a positive shut off mechanism without the need for extra parts (ref. the discussion accompanying FIG. 13 above).

(d) The system uses a reservoir and actuator designed in such a way as to realize the additional advantages of establishing a one way valve mechanism for sealing the dip tube on the downstroke cycle (ref. the discussion accompanying FIGS. 2, 3(*a*) and 3(*b*) above), and also establishing a drain back mechanism for discharging undispensed product back into the container without the need of extra parts for either function. The drain back mechanism has two important functions. It is a safety feature: because the pressurized product drains back out of the reservoir, the dispenser head assembly will not discharge without having been charged shortly in advance of discharge. In addition, it is a feature which prolongs the life of the system: because the pressurized product drains back out of the reservoir, the reservoir cannot remain unused in its expanded state for prolonged periods of time.

Figure 13:
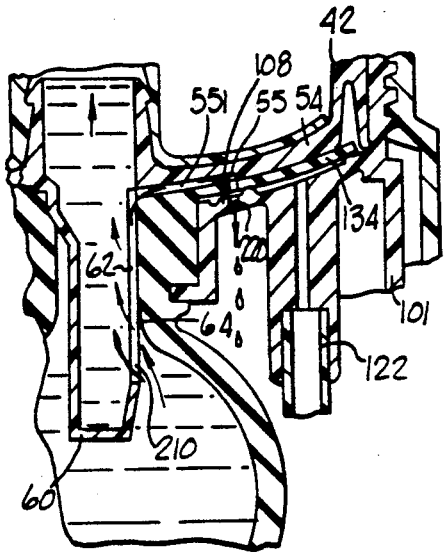
FIG. 13 is an enlarged view of a portion of the dispensing head assembly in the fully closed phase of the charging cycle, showing details of the product flow channels.
Figure 14:
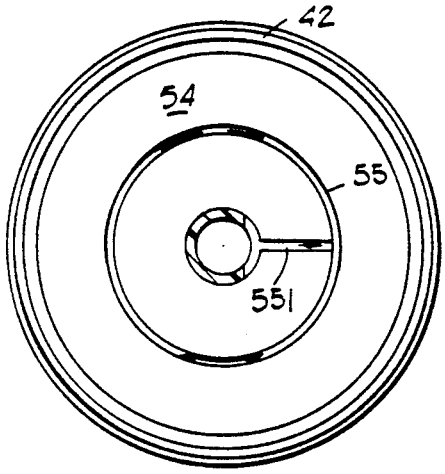
FIG. 14 is a cross sectional cut away view of FIG. 2 showing details of the product flow channels on the underside of the piston.

The drain back mechanism is formed in three different ways, corresponding to each of the embodiments of the actuator assembly 100 already described. First the channels on the floor 54 of the piston 42, common to the first and second embodiments, will be discussed, then the particulars of each embodiment will be explained. With reference to FIG: 2, it has already been seen that there is an annular groove 55 on the underside of the floor 54 of the piston 42. This annular groove 55 may also be seen in FIG. 13, and forms one of the channels for draining back product out of the reservoir 130. The other channel is a radial groove 551 which, as can be seen in FIG. 13, is a groove scored on the underside of the floor 54 of the piston 42. The radial groove 551 runs from the slot 62 of the finger 60 of the piston 42 to the annular groove 55, creating a fluid flow path from the inside of the piston 42 to the channel formed by the annular groove 55. The orientation of the two channels can also be seen with reference to FIG. 14, which shows the underside of the floor 54 of the piston 42. The annular groove 55 forms one circular channel, and the radial groove 551 forms the other channel, communicating along the radius of the floor 54 of the piston 42 between the center of the piston and the annular groove 55. Next, the three particular embodiments of the drain back mechanism will be discussed.

The first embodiment of the actuator assembly 100, discussed with reference to FIG. 2 above, is the one in which the reservoir 130 has a horizontal flange 134. The corresponding drain back mechanism can be better understood with reference to FIG. 13. When the reservoir 130 expands under pressure, the channel 210 of the finger 60 is open and product can flow through the slot 62 of the finger 60. In addition to flowing into the inside of the piston 42 (see, e.g., FIG. 12), the product is also able to flow, as shown by the arrows in FIG. 13, into the channel of the radial groove 551 of the piston 42, and thence into the channel of the annular groove 55 of the piston 42. One or more holes 220 drilled beneath the annular groove 55 of the piston 42 and through the horizontal flange 134 of the reservoir 130 and through the floor 108 of the actuator 101 permit product to drain back out of the reservoir 130 and into the container. Moreover, if the annular groove 55 of the piston is oriented so that its circumference is over the dip tube 122, there is no need to drill through the floor 108 of the actuator. The number and size of the hole(s) 220 can be easily set so as to permit a precisely controlled rate of drain back appropriate for the product being dispensed.

The second embodiment of the actuator assembly 100, discussed with reference to FIG. 3(*a*) above, is the one in which there is a check ball 124. The corresponding drain back mechanism is achieved by making an out-of-smooth finish tolerance between the check ball 124 and the tapering wall 118 of the tube housing 114 in which the check ball sits. The surface of the check ball 124, and/or the surface of the tapering wall 118 can be made out-of-smooth in order to produce an imperfect seal between the ball 124 and the wall 118, so that product can pass back into the dip tube 122. Referring to FIGS. 13 and 3(*a*) together (substituting the embodiment of FIG. 3(*a*) into the schematic of FIG. 13), it can be understood that, as the pressurized product is able to flow from the reservoir 130, into the radial groove 551 and into the annular groove 55 of the floor 54 of the piston 42 above the tube housing 114 in the floor 108 of the actuator 101, product will slowly drain back down the dip tube 122 through the imperfect seal formed by the check ball 124. The degree of out-of-smoothness between ball 124 and tapering walls 118 can be set to provide a controlled rate of drain back appropriate for the product being dispensed.

The third embodiment of the actuator assembly 100, discussed with reference to FIG. 3(*b*) above, is the one in which the reservoir 130 has a vertical flange 136. It can be seen that the height of the reservoir 130 and vertical flange 136 is slightly less than the height that would be flush against the floor 108 of the actuator 101, and that an open chamber (not separately numbered) is thereby formed within the reservoir housing 110 of the actuator 101. The corresponding drain back mechanism can be better understood with reference to FIG. 13(*b*). When the reservoir 130 expands under pressure, the channel 210 of the finger 60 is open and product can flow through the slot 62 of the finger 60. In addition to flowing into the inside of the piston 42 (see, e.g., FIG. 12), the product is also able to flow, as shown by the arrows in FIG. 13(*b*), into the open chamber within the reservoir housing 110 of the actuator 101. One or more holes 220 drilled through the bottom of the reservoir housing 110 of the actuator 101 permit product to drain back out of the reservoir 130 and into the container. The number and size of the hole(s) 220 can be easily set so as to permit a precisely controlled rate of drain back appropriate for the product being dispensed.

(e) The system uses a piston sealing mechanism which produces a tight seal while have an unexpectedly low coefficient of friction so as to make the mechanical twisting motions of the cap and actuator relatively easy. Because the mechanical advantage of the dispensing head assembly is gained by twisting the cap about the actuator, it is important that energy not be lost to the friction between those members. The earlier discussion of the piston 42 with reference to FIG. 2 has identified a nib 48 and a flexible outer wall 44 folding downwards from an inner wall 52 of the piston about a shoulder 50. When the charging chamber 200 is opened and closed (ref. FIGS. 11 and 12), the nib 48 of the piston 42 prevents the full length of the outer wall 44 of the piston 42 from rubbing against the wall 102 of the actuator 101. Instead, it is the nib 48 itself which rubs against the wall 102 of the actuator 101. The coefficient of friction is reduced because of the small area of contact between nib 48 and actuator 101. Additional advantages may be obtained by judicious selection of different polymer materials for molding the actuator 101 and the piston 42 so that the nib 48 of the piston will more smoothly ride over the actuator 101.

While the nib 48 of the piston 42 acts to reduce friction, the flexible outer wall 44 of the piston acts to create a tight seal, particularly on the downstroke of the piston 42 when compression is most important. By comparing FIGS. 11 and 12 with FIG. 2, it should be understood that the downstroke of the piston 42 compresses product within the gap formed between the inner wall 52 and outer wall 44 of the piston 42. This compression urges the angle formed between the inner wall 52 and outer wall 44 at the shoulder 50 to open. As the angle opens at the shoulder 50, the outer wall 44 of the piston 42 is more strongly urged against the wall 102 of the actuator 101. The effect is to press the nib 48 on the outer wall of the piston 42 more tightly against the wall 102 of the actuator 101, creating a tighter seal within the charging chamber on the downstroke cycle of the piston 42.

Figure 15:
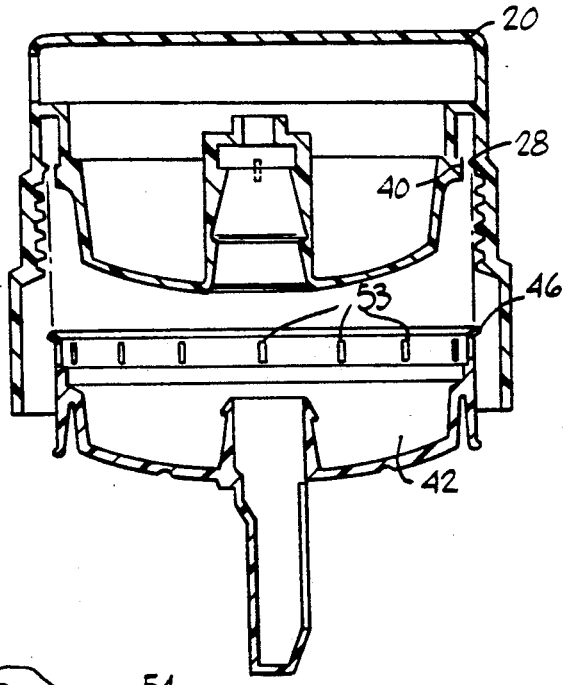
FIG. 15 is an exploded plan view of the cap and piston, showing details of the anti-slip slots of the piston and ribs of the cap.
Figure 13B:
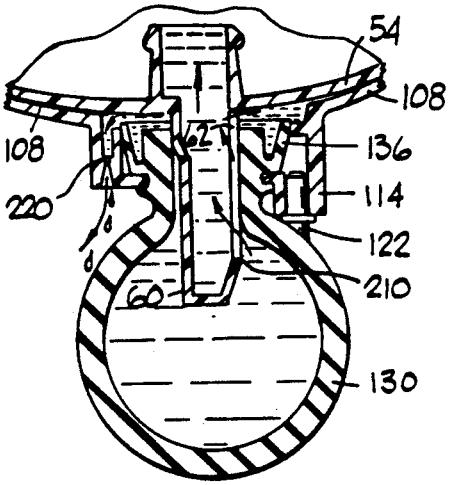

The foregoing are the advantages previewed in the "Summary of the Invention" above. Some of the other advantages and specific improvements of the system of this invention are these:

There is an "anti-slip" mechanism provided so that the piston 42 will not slip against the cap 20 as the cap is twisted about the actuator 101 to raise the piston. With reference to FIG. 15, it can be seen that there are a number of vertical slots 53 on the inner wall 52 of the piston 42, and a number of vertical ribs 40 on the inside of the cap 20. In one embodiment, the number of vertical slots 53 is about thirty, equidistantly spaced about the inner wall 52 of the piston, and the number of vertical ribs 40 is about four, equidistantly spaced about the inside of the cap 20. The ribs 40 are oriented to the slots 53 so that each rib 40 will slip into, and engage with, a slot 53, and hold in place thereafter. The number of ribs 40 and slots 53 is such that there will be only a short turn before the ribs 40 find a corresponding slot 53 with which to engage. Once the piston 42 is engaged with the cap 20, the successive twistings of the cap will twist the piston in a synchronized fashion and will prevent the piston retaining bead 28 of the cap 20 from rubbing against the snap rim 46 of the piston 42 and causing excess wear to the piston 42.

There is a skirt 103 about the bottom of the actuator 101, described in connection with FIG. 2, which can be gripped by an operator's hand as the operator twists the dispensing head assembly to operate it (the other hand will grip the cap of the dispensing head assembly). As can be seen with reference to FIG. 16, the skirt 103 can be extended downwards and over the container 12 so as to lengthen the skirt 103, providing a greater surface area for the operator's grip. In addition, by using the longer skirt 103 of FIG. 16, it is possible to prevent the operator from twisting the container itself to operate the system (with reference to, e.g., FIG. 1, it should be understood that the operator might otherwise twist with one hand gripping the container itself and the other hand gripping the cap; in which case it would be crucial that the "bayonet" or other "twist resistant" attachment system between dispensing head assembly 10 and container 12 work so as to prevent the operator from accidently twisting the dispensing head assembly 10 off from the container 12). By using the lengthened skirt 103 of FIG. 16, there is no operator pressure on the container, and no need to ensure a twist resistant attachment between container and dispensing head assembly.

Thus, an ordinary screw fitting can be used between the container 12 and the dispensing head assembly 10.

The charging chamber cannot be overcharged by repeated twisting after the charging cycle has once been accomplished—this is because any subsequent opening of the charging chamber would cause the charging chamber to be filled, not from the container through the dip tube, but from the already charged reservoir.

The system is designed to use conventional subassemblies for input means (including ordinary bottles and dip tubes) and output means (including standard discharge means), while the system itself is assembled from a relatively small number of parts, all of which can be easily injection molded.

The system, even when fitted to a filled container, is, at the fully closed position of the initial cycle, in an unpressurized condition—the fitted and filled containers can be safely shipped and stored indefinitely. The seal between the dispensing head assembly 10 and the container 12 is enhanced by a gasket (not shown) between the actuator 101 of the dispensing head assembly 10 and the container 12. The gasket may be a separate piece, or may be an appendage molded into the actuator 101 or molded into the container 12.

The vent hole 106 of the actuator 101 (ref. FIG. 2) is located in such a position that the vent hole 106 is effectively covered during the fully closed phase of the charging cycle by the bottom surface of the outer wall 26 of the cap 20, but is effectively uncovered during the fully opened phase of the charging cycle (compare FIGS. 11 and 12 with FIG. 2)—this working of the vent hole 106 permits pressure equalization as needed without adversely affecting the charge.

The important fluid flow passages of the system, including the inside of the piston 42 (ref. FIG. 4), the inside of the spring housing 72, and the inside of the valve 80, are designed so that the openings are progressively smaller. As a result of the successively smaller areas available to the fluid contents of the system, pressure loss is minimized.

Finally, although this embodiment of the system of the invention realizes a mechanical advantage by use of screw threads by which the cap is movably attached to the actuator, it should be readily understood that the system of this invention can be embodied in other mechanical means for moving the cap relative to the actuator, including such structures as cams, levers, ratchets and gears.

In one embodiment, the materials and dimensions of the system of this invention are substantially as follows:

The cap 20 is formed of high density polyethylene (HDPE); the piston 42 is formed of HDPE; the actuator 101 is formed of polypropylene; the reservoir 130 may be formed of thermal plastic rubber (e.g., nitrile, neoprene, EPDM, urethane) or silicone, VITON BRAND or other elastomer, depending on chemical compatibility between the reservoir 130 and the product to be discharged; the dip tube 122 is formed of HDPE, 4.75" long, bevel cut at the bottom, having an inner diameter of 0.093" and an outer diameter of 0.158"; the container 12 is formed of HDPE; and the check ball 124 (of the second embodiment shown in FIG. 3*a*) is stainless steel, 0.125" in diameter.

The discharge assembly 70 (valve and spray head) is one of many that are commercially available. It is believed that the spray head 84 is formed of HDPE; the valve 80 is acetal; the gasket 76 is nitrile; the spring housing 72 is nylon; and the spring 78 is stainless steel.

The cap 20 is about 2.052" high, having an outer diameter of about 2.322" at its widest point. The diameter of the floor 24 of the cap 20 is about 1.660". The outer diameter of the interior cylinder 34 of the cap 20 is about 0.489". The vertical rise of the screw threads 30 of the cap 20 is about 0.378" (measuring the vertical length of the wall 26 of the cap 20 on the non-threaded side), and the wall 26 of the cap 20 has a total length of about 1.373".

The piston 42 is about 1.557" high (measured from the top of the piston 42 to the bottom of the finger 60 of the piston 42), and the finger 60 is about 0.948" high. The piston 42 has an outer diameter of about 2.006" at its widest point (measured from the outside of the snap rim 46). The floor 54 of the piston 42 has a diameter of about 1.660". The finger 60 of the piston 42 has an inner diameter of about 0.333" at its widest point (measured at about the point that the finger 60 meets the floor 54 of the piston 42). The slot 62 of the finger 60 is about 0.753" long and about 0.030" wide, and the ridge 64 around the slot 62 is about 0.005" high and about 0.020" wide. The outer wall 44 of the piston 42 is about 0.560" high, with the shoulder 50 being about 0.207" up from the bottom of the outer wall.

The actuator 101 is about 1.501" high (measured from the top of the actuator 101 to the bottom of the skirt 103 of the actuator. The actuator 101 has an outer diameter of about 2.330" at its widest point (measured at the bottom). The floor 108 of the actuator 101 has a diameter of about 1.916". The inner diameter of the reservoir housing 110 is about 0.750" at its widest point (measured at about the point where the reservoir housing 110 meets the floor 108 of the actuator 101). The height of the skirt 103 is about 0.427" (but may be substantially longer).

The reservoir 130 is, when relaxed, about 1.804" high, having an outer diameter of about 0.550" at a point about midway along its length, and an inner diameter of about 0.333". The horizontal flange 134 of the first embodiment (shown, e.g., in FIG. 2) is about 1.845" in diameter. The vertical flange 136 of the third embodiment (shown in FIG. 3*b*) is about 0.301" in length.

The container 12 is about 4.683" high, having an outer diameter of about 2.800" at its widest point (measured at the bottom) and about 2.056" at its narrowest point (measured at the top). The container has a capacity of about 9.8 ounces.

It should now be apparent that the system of this invention is a non-chemical aerosol that works from any position, even upside down, does not require a finger pump to actuate, and can be fitted to disposable or reusable containers. Further, the system of this invention produces a duration spray which does not become a wet stream or dribble near the end of the cycle, and a finely atomized high pressure spray which does not take inordinate mechanical force to charge. The system of this invention is simple and uses relatively few parts, all of which can be easily fabricated from existing materials that can be injection molded with existing mold techniques.

What is claimed is:

1. A mechanically pressurized system for dispensing a product, comprising:

(a) a cap having an interior cavity, (b) a cylindrically shaped piston closed at one end and having a face at said end, said piston being seated in said cap and disposed so that the face of the piston is within the interior cavity of said cap, said face having a circular cross section, (c) a cylindrically shaped actuator having a side wall and a floor, said actuator moveably attached to said cap for movement of the cap relative to the actuator in a first direction along the axis of said piston and for movement of the cap relative to the actuator in a second direction along the axis of said piston, the actuator and cap being referred to herein, when so attached to one another, as a dispensing head assembly, (d) a charging chamber contained within the dispensing head assembly, said charging chamber having a floor, a side wall, and a top, which are defined by the floor of the actuator, the side wall of the actuator, and the face of the piston, respectively, wherein movement of the cap relative to the actuator in said first direction raises the piston and opens the charging chamber, and movement of the cap relative to the actuator in said second direction lowers the piston and closes the charging chamber, (e) inlet means, including a dip tube having a first end and a second end, said first end being in fluid communication with a product source containing said product, and said second end being in fluid communication with the charging chamber for moving the product into the charging chamber from the product source as the charging chamber is opened, (f) expanding resistant reservoir means in fluid communication with the charging chamber for receiving product from the charging chamber as the charging chamber is closed, said reservoir means expanding to hold the product against a force of resistance, and (g) outlet means in fluid communication with the expanding resistant reservoir means for moving product out of the expanding resistant reservoir means whereby said force of resistance is used to move said product.

2. The system of claim 1, further comprising a support within said cap and wherein said face of the piston is supported by said support.

3. The system of claim 2, further comprising (a) a snap rim on said piston, and a retaining bead on said cap, for snapping the piston into the cap and retaining the piston within the cap, and (b) anti-rotation means on said piston and cap for preventing the piston and cap from rotating relative to one another.

4. The system of claim 3, further comprising:

(a) an inner piston wall, said inner piston wall having a top and a bottom, the bottom being attached to the periphery of the face of the piston, (b) an outer piston wall, said outer piston wall having a top and a bottom, the outer piston wall being affixed to said inner piston wall at a fluid-tight juncture, said juncture being between the top and bottom of the inner wall and between the top and bottom of the outer wall, forming thereby a double-walled piston, wherein said inner piston wall and said outer piston wall are formed of a flexible material for flexing the outer piston wall away from the inner piston wall at said juncture as a pivot point, the outer piston wall being disposed within said charging chamber adjacent to the side wall of said chamber for sealing the charging chamber so that, and especially as the piston is lowered to close the charging chamber, the outer piston wall is forced away from the inner piston wall, thereby urging the outer piston wall more tightly against the side wall of the charging chamber for tightening the seal of the piston against said wall as the piston is lowered.

5. The system of claim 4, further comprising a band formed around the outside periphery of the outer wall of the piston near the bottom of said wall, said band having an upraised spherical cross section oriented towards the side wall of the charging chamber for tightening the seal of the piston against said wall as the piston is lowered while also minimizing the coefficient of friction, said band being essentially the only element of the piston which rubs against the wall of the charging chamber.

6. The system of claim 5, wherein said band is formed of a first material and said side wall of the charging chamber is formed of a second material, the first and second materials being selected so as to reduce the coefficient of friction between them.

7. The system of claim 1, further comprising a finger attached to the face of the piston, said finger oriented so that the finger is adjacent to an opening in the expanding resistant reservoir means and said finger is inserted into said opening when the piston is lowered, thereby further increasing the pressure within the expanding resistant reservoir means when the piston is lowered.

8. The system of claim 7, wherein the finger is oriented near the opening of the expanding resistant reservoir means, and is partially inserted into the expanding resistant reservoir means when the charging chamber is open.

9. The system of claim 8, wherein the finger is inserted more deeply into the expanding resistant reservoir means when the charging chamber is closed than when the charging chamber is open.

10. The system of claim 8, further comprising:

(a) a slot on said finger, said slot running lengthwise on an outer surface of the finger and penetrating said surface of the finger, and (b) a moveable surface within the expanding resistant reservoir means, said surface moving in a first direction when product is received into the expanding resistant reservoir means, and said surface moving in a second direction when product is moved out of the expanding resistant reservoir means, wherein the finger is in fluid communication with said outlet means, and the slot of said finger forms a channel to move product out of the expanding resistant reservoir means into the outlet means, said slot being oriented towards the movable surface of the expanding resistant reservoir so that, as said surface moves in said first direction, said surface is moved away from the slot, opening said channel for movement of product out of the expanding resistant reservoir means and into the outlet means, and as said surface moves in said second direction, said surface is moved towards the slot, closing said channel for shutting off movement of product from the expanding resistant reservoir means into the outlet means.

11. The system of claim 10, wherein the dimensions and relative movement of the movable surface of the expanding resistant reservoir against the slot of the finger are set so that the flow of product is shut off from moving to the outlet means before said force of resistance is completely released, so as to operate as a postive shut off while the product is still being forcefully discharged outlet means and before the product is allowed to dribble out of the outlet means.

12. The system of claim 1, further comprising one way means within the charging chamber for permitting a one way flow of product through said dip tube of the inlet means into the charging chamber when the piston is raised, while preventing the reverse flow of product back out of the charging chamber through the dip tube when the piston is lowered.

13. The system of claim 12, further comprising drain back means within the charging chamber, said drain back means being in fluid communication with said expanding resistant reservoir means for automatically draining product back out of the expanding resistant reservoir means so as to prevent the expanding resistant reservoir means from holding said product against a force of resistance for a prolonged period of time (new).

14. The system of claim 13, in which the one way means includes:

(a) an enlarged opening at the floor of the actuator, said enlarged opening being wide enough to seat a check ball within a cavity formed beneath the plane of the floor of the actuator, the cavity extending downward from the floor of the actuator to a shoulder, and said cavity tapering downwards and inwards from said shoulder until joining said first end of the dip tube of the inlet means, (b) retaining rods, each having a bottom and a top, and each said retaining rod being attached at the bottom to a location near the shoulder of the cavity, and each retaining rod being angled upwards and inwards towards its top so as partially to enclose the cavity, and (c) a check ball seated within the cavity and loosely contained therein by the retaining rods, wherein the check ball is lifted slightly above the surface of the cavity when the piston is raised, but is pressed tightly against the surface of the cavity when the piston is lowered, thereby allowing product into the charging chamber when the piston is raised while preventing the reverse flow of product when the piston is lowered.

15. The system of claim 14, in which the drain back means includes an out-of-smooth finish on at least one of the surface of the check ball and a surface of the cavity, thereby creating an imperfect seal between the check ball and said surface so that the product drains back out of the charging chamber through the inlet tube, thereby releasing said force of resistance.

16. The system of claim 15, wherein the degree of out-of-smooth finish is set so that a controlled rate of drain back, appropriate to prevent the expanding resistant reservoir means from holding said product against a force of resistance for a prolonged period of time, is attained.

17. The system of claim 13, in which the one way means includes a horizontal flange attached to the expanding resistant reservoir means, said horizontal flange essentially covering the floor of the charging chamber above the inlet means, wherein the horizontal flange is lifted slightly above the inlet means when the piston is raised, but is pressed tightly against said inlet means when the piston is lowered, thereby allowing product into the charging chamber when the piston is raised while preventing the reverse flow of product when the piston is lowered.

18. The system of claim 17, in which the drain back means includes:

(a) a first channel and a second channel formed on the face of the piston, the first channel being a radial groove and the second channel being an annular groove, the first channel communicating along a radius of the face from about the center of the face of the piston to the second channel further away from the center of the face, (b) a fluid passageway from the expanding resistant reservoir means to said first channel, and (c) at least one hole formed in the horizontal flange of the expanding resistant reservoir means and a corresponding hole in the floor of the charging chamber, said holes being formed beneath said second channel, wherein the product drains out of the expanding resistant reservoir means, into said first and second channels, and out of the charging chamber by way of said holes formed in the horizontal flange of the expanding resistant reservoir and the floor of the actuator beneath the second channel, thereby releasing said force of resistance.

19. The system of claim 18, wherein the number and diameter of said at least one is set so that a controlled rate of drain back, appropriate to prevent the expanding resistant reservoir means from holding said product against a force of resistance for a prolonged period of time, is attained.

20. The system of claim 13, in which the one way means includes a vertical flange attached to the expanding resistant reservoir means, said vertical flange covering the inlet means to the charging chamber, wherein the vertical flange is deflected slightly away from the inlet means when the piston is raised, but is pressed tightly against the inlet means when the piston is lowered, thereby allowing product into the charging chamber when the piston is raised while preventing the reverse flow of product when the piston is lowered.

21. The system of claim 20, in which the drain back means includes:

(a) a chamber within the actuator, said chamber being in fluid communication with the expanding resistant reservoir means, and (b) at least one hole formed in said chamber, wherein the product drains out of the expanding resistant reservoir means, into the chamber, and out of the chamber by way of the hole formed in the chamber, thereby releasing said force of resistance.

22. The system of claim 21, wherein the number and diameter of said at least one is set so that a controlled rate of drain back, appropriate to prevent the expanding resistant reservoir means from holding said product against a force of resistance for a prolonged period of time, is attained.

23. The system of claim 1, further comprising a screw thread on said cap and a complementary screw thread on said actuator so that the cap and actuator are moveably attached to one another by being screwed together, wherein said movement of the cap in said first direction relative to the actuator is by a twisting motion in one of the directions clockwise or counterclockwise, and the movement of the cap in said second direction relative to the actuator is by a twisting motion in the other of the directions clockwise or counterclockwise.

24. The system of claim 23, further comprising:

(a) a number of ribs on one of the cap and the piston, and (b) a corresponding number of slots on the other of the cap and the piston, said ribs and slots being so disposed that, when the cap is twisted relative to the actuator, thereby urging the piston to rotate relative to the cap, said ribs will slip into and engage with said slots, preventing the cap and piston from rotating relative to one another (new).

25. The system of claim 23, further comprising:

(a) a notched tooth in the cap, and (b) a complementary notched tooth in the actuator, wherein said notched teeth come into contact with one another so as to arrest movement in the first direction, preventing the cap from becoming unscrewed from the actuator as the piston is being raised.

26. The system of claim 25, wherein said twisting motion is less than 360 degrees.

27. The system of claim 1, wherein the product source is a container that is attached to the dispensing head assembly.

28. The system of claim 27 wherein the container is permanently attached to the dispensing head assembly.

29. The system of claim 27, wherein the container is removably attached to the dispensing head assembly for refilling or replacing the container.

30. The system of claim 29, further comprising a skirt extending from the actuator, said skirt providing an operator hand grip apart from the container so that the operator may twist the dispensing head assembly without twisting the container, for preventing the inadvertent removal of the container from the dispensing head assembly.

31. The system of claim 29, further comprising a bayonet fitting for attaching the container to the dispensing head assembly.

32. The system of claim 1, wherein the product source is a container that is not attached to the dispensing head assembly, said container communicating with said dispensing head assembly only by way of said dip tube.

33. The system of claim 1, further comprising vent means in communication with said product source for venting air into the product source in response to the action of the dispensing head assembly.

34. The system of claim 1, further comprising a fluid passageway within said outlet means, said passageway becoming progressively more narrow in diameter along its length for maintaining fluid pressure.

35. The system of claim 1, wherein subsequent movements of the cap in said first direction and second direction relative to the actuator, after the initial such movements and before said force of resistance has been released, moves the product out of the expanding resistant reservoir means and into the charging chamber, preventing overfilling of the charging chamber with additional product from the product source.

* * * * *